United States Patent [19]

Balligand et al.

[11] 4,231,171

[45] Nov. 4, 1980

[54] METHOD AND APPARATUS FOR MINING NODULES FROM BENEATH THE SEA

[75] Inventors: Pierre Balligand, Sceaux; Yves Corfa, Nantes; Pierre Lemercier, Grenoble; Paul Marchal, Gif-sur-Yvette; Jean Vertut, Issy les Moulineaux, all of France

[73] Assignee: Commissariat a l'Energie Atomique, France

[21] Appl. No.: 869,148

[22] Filed: Jan. 13, 1978

[30] Foreign Application Priority Data

Jan. 18, 1977 [FR] France ..... 77 01288

[51] Int. Cl.[3] ..... E02F 3/88

[52] U.S. Cl. ..... 37/54; 37/56; 37/58; 37/DIG. 8; 114/313; 114/332; 114/338

[58] Field of Search ..... 37/56, DIG. 8, 58; 114/313, 332, 338; 405/185, 191

[56] References Cited

U.S. PATENT DOCUMENTS

| | | | |
|---|---|---|---|
| 3,169,500 | 2/1965 | Cousteau et al. | 405/185 X |
| 3,812,922 | 5/1974 | Stechler | 37/56 X |
| 4,010,560 | 3/1977 | Diggs | 37/DIG. 8 |
| 4,035,022 | 7/1977 | Hahlbrock et al. | 37/DIG. 8 |

FOREIGN PATENT DOCUMENTS

| | | | |
|---|---|---|---|
| 2089926 | 1/1972 | France | 37/DIG. 8 |

OTHER PUBLICATIONS

Lockwood, George S., "Engineering Aspects of Mineral Recovery from the Ocean Floor"; *Mining Engineering*, Aug., 1964; pp. 45–49.

*Primary Examiner*—Clifford D. Crowder
*Attorney, Agent, or Firm*—Thomas J. Greer, Jr.

[57] ABSTRACT

Polymetallic nodules are collected by means of a plurality of self-propelled vehicles which move upwards and downwards between the sea floor and a surface platform under the action of excess ballast which is partially and progressively released as the vehicle approaches the bottom. The vehicles are propelled along the sea floor by means of at least two supporting units each having at least one helical propulsion fin, the remainder of the ballast being released in order to return the vehicles upwards for docking, unloading and energy-recharging in the surface platform.

10 Claims, 8 Drawing Figures

METHOD AND APPARATUS FOR MINING NODULES FROM BENEATH THE SEA

Figure 1:
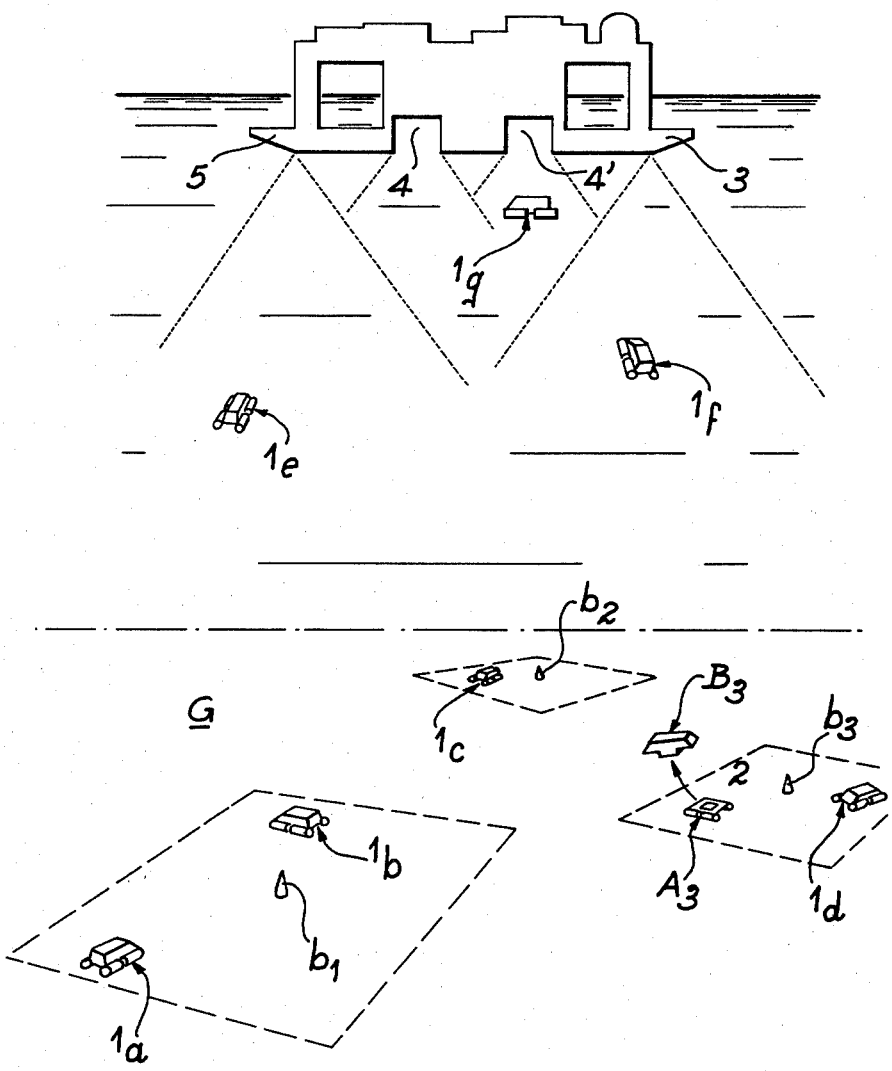

This invention relates to a method of exploitation of a deposit of polymetallic nodules located at a substantial depth beneath the ocean surface, as well as the collecting vehicles and the surface platform required for the practical application of said method.

Polymetallic nodules constitute a desirable source of ores and many systems have been investigated for the exploitation of nodule deposits.

However, the systems designed prior to the present invention usually make use of a surface vehicle and a dredging vehicle connected together by means of a hydraulic lifting-tube which is normally maintained in the vertical position. Systems of this type do not make it possible to obtain a sufficiently high rate of recovery of nodules which are present in the exploitation field since they are not conducive to dredging passes carried out in close succession.

Furthermore, the operation of these systems proves both difficult and unreliable. In fact the entire system including the lifting-tube and the surface vehicle must move at the dredging speed which is accordingly limited, prevents any rapid reaction in the event of obstacles and calls for total stoppage at the time of failure of one of the system components.

Moreover, the means usually employed in systems of this type for application and propulsion of the dredging vehicle on the sea floor are not adapted to a sediment which has a low supporting capacity and cannot readily be detached from the components to which it adheres.

The present invention is directed to a method of exploitation of a deposit of polymetallic nodules on a sea floor which makes it possible to optimize the productivity of this exploitation, to provide the degree of flexibility of exploitation which permits adaptation to deposits having variable characteristics, and to maintain the maximum productivity by means of continuous maintenance of the exploitation means.

The method of exploitation in accordance with the invention is distinguished by the fact that the collection and upward displacements of the nodules are carried out by means of a plurality of self-propelled collecting vehicles which move downwards and upwards under the principal action of a releasable ballast, which dredge the nodules while being propelled along the sea floor by means of supporting units each provided with a helical propulsion fin, which discharge the nodules into the immersed portion of a surface platform and which are charged with energy and ballast during this discharge operation.

In accordance with a preferential alternative embodiment of the method, the releasable ballast is mostly constituted by the sterile wastes derived from the processing of the nodules. This alternative embodiment offers a number of economic and technical advantages since it permits the possibility on the one hand of reducing the weights to be transported and stored in the surface platform and, on the other hand, of replacing on the sea floor materials which have been extracted therefrom and therefore of modifying the environment to the minimum extent.

This invention is also directed to a self-propelled vehicle and to a surface platform for carrying out said method. The self-propelled vehicle is capable of moving satisfactorily over a deep-sea bed and of ensuring that connections between the surface installation and the sea floor located at a substantial depth are established under the best possible conditions.

The self-propelled nodule-collecting vehicle in accordance with the invention is composed of a body, at least two supporting units and/or propulsion units of revolution. The walls of said units are intended to be applied against said sea floor and rigidly fixed to at least one helical propulsion fin. Means connected to said body are intended to drive said units in rotation about their axis of revolution. The vehicle further comprises a dredge mounted on said body, a silo for storing the nodules collected by said dredge, means for transferring the nodules from the dredge into said silo. The vehicle is essentially constituted by an open structure and is provided with means for modifying its specific weight, said means being such as to comprise a buoyancy unit, a silo containing a releasable ballast, an adjustable ballast system, and diving tail-planes.

In a preferential alternative embodiment, the dredge is placed at the front end of the vehicle and has a width at least equal to the overall length of the supporting units.

The foregoing arrangement has the advantage of applying the propulsion units against a zone which has already been dredged. This prevents any modification of the sea floor outside this zone and permits adjacent dredging furrows.

A chief advantage of the vehicle in accordance with the invention for the purpose of collecting nodules on a sea floor lies in the fact that said vehicle is particularly well-suited to slow and uniform displacement over a bottom surface which has both a low and variable supporting capacity and in which the sediments exhibit high adherence in contact with the bearing elements. This advantage is combined with the possibility of transferring vehicles in downward and upward motion with an expenditure of mechanical energy in the propulsion units which is limited to the final stages of landing and docking with the platform.

Continuous dynamic application of the vehicle against the sea floor is ensured by the above-mentioned supporting and propulsion units as a result of displacement of water when the speed of rotation of said units is sufficient. Furthermore, a reduction in supporting capacity of the sea bottom and an increase in pressure exerted by the vehicle on said bottom can be compensated by an increase in area of application of the units on the sea bottom and an effect of hydrostatic lift produced by the sediments.

It is worthy of note at this point that, in the case of a suitable speed of rotation of said supporting and propulsion units, said units can ensure underwater propulsion of the vehicle which is useful in the final stages aforesaid.

Moreover, downward motion of the vehicle is ensured by means of an excess ballast. In accordance with an advantageous feature, the silo or silos placed within said vehicle for containing the releasable ballast is (are) placed at the center of gravity of this latter beneath and in front of the center of hydrodynamic thrust of the vehicle.

During downward motion, the center of gravity of the vehicle is therefore displaced towards the forward end of the vehicle and this latter accordingly assumes a steeply incined position, the longitudinal component of the excess ballast being such as to ensure downward progression along the inclined path.

In accordance with a further characteristic feature, the silo for storage of collected nodules is placed beneath the center of thrust and has a specific weight capacity at the moment of completion of the collecting operation which is smaller than that of the previous silo. At this moment, the vehicle acquires positive buoyancy under the action of release of the excess ballast remaining within the silo located at the forward end of the vehicle, thus ensuring propulsion for upward travel. As a result of rearward displacement of the center of gravity, the vehicle is lifted up and returns upwards towards the surface of the sea with an inclined trim which is symmetrical with the trim maintained during downward travel. Advantageously, a hydropneumatic ballasting element makes it possible to adjust the specific weight of the vehicle with an expenditure of energy which is limited to the time of adjustment, namely either in the vicinity of bottom-landing or (and mainly) at the time of docking with the platform.

In an alternative embodiment, the vehicle comprises means for releasing a portion of the body which has fixed buoyancy. This release makes it possible to revert to a zero coefficient of buoyancy in order to prevent the vehicle from reaching the surface in the event of difficulties encountered at the time of docking operations, namely when coupling the vehicle to the immersed portion of the platform. In an advantageous form of construction, said releasable portion is located at the forward end of the vehicle.

The vehicle in accordance with the invention can further comprise tail-planes and at least one propulsion unit for generating a vertical thrust, at least one propulsion unit for generating a transverse thrust with respect to said body, and if necessary a propulsion unit for generating a longitudinal thrust.

The vehicle defined in the foregoing has the advantage of being particularly well-suited to the construction of a system for exploitation of a deposit of polymetallic nodules comprising on the one hand a plurality of self-propelled vehicles operating independently of each other and, on the other hand, a surface platform which is primarily intended to permit docking of vehicles, unloading of nodules, re-loading of vehicle silos with releasable ballast as well as energy-recharging of said vehicles.

The vehicle in accordance with the invention can also be constituted by two separable and superposed modules both having an open structure, the lower module being provided with the supporting and/or propulsion units aforesaid, said dredge and the upper module being equipped with said propulsion units, said storage silos and said means for adjusting the specific weight of the vehicle. Said vehicle permits upward transfer of the nodules into the surface platform and facilitates location of the position occupied by the vehicle prior to upward return in order to continue the collection of nodules from one zone of a deposit since the propulsion module remains at the point corresponding to completion of the collecting operation and to separation of the modules.

In accordance with the invention, the platform which is positioned at the surface comprises means for docking the above-defined vehicles in an immersed portion, means for unloading said vehicles in silos immersed at equal pressure with respect to the surrounding water, means for loading said vehicles with releasable ballast from silos placed in the same locations as said unloading silos, and means for energy recharging of said vehicles.

In a preferential alternative embodiment, chemical treatment of collected nodules is performed on the platform itself. The ballast which is loaded within the vehicles is in this case mainly constituted by sterile wastes which are derived from said treatment and to which is added a small quantity of similar steriles or sediments of any type which may also be stored at equal pressure.

Figure 2A:
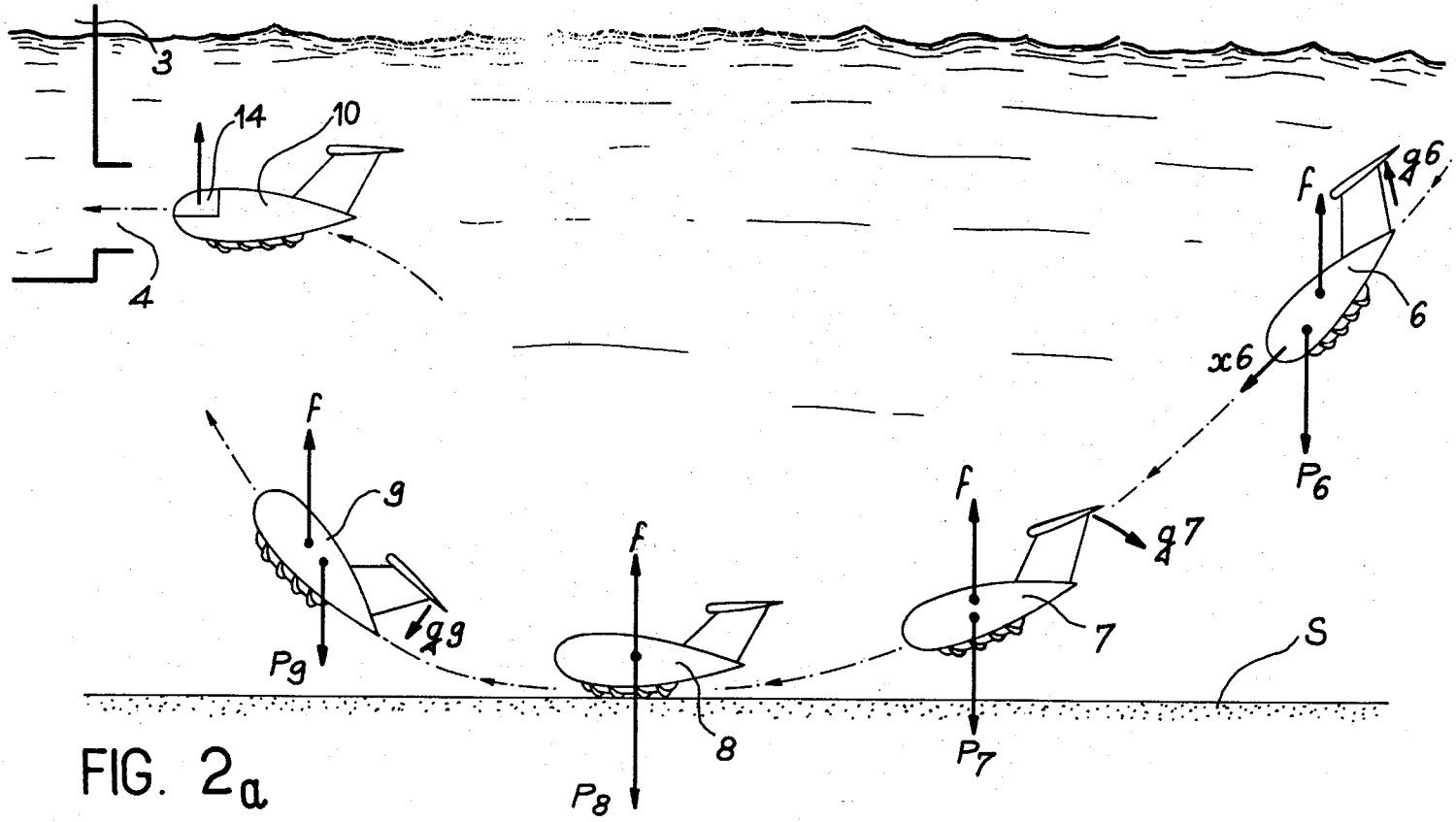
Figure 2B:
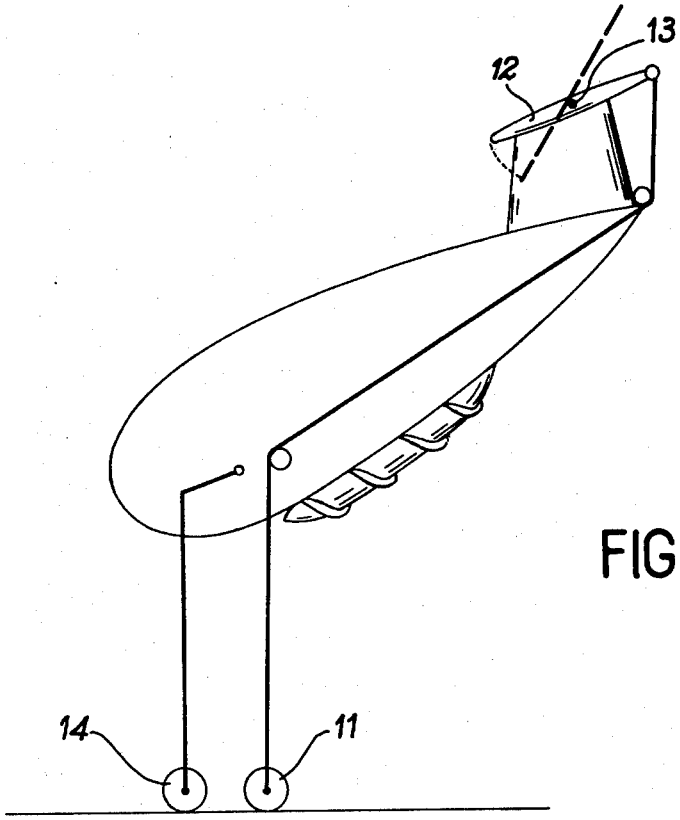
Figure 3A:
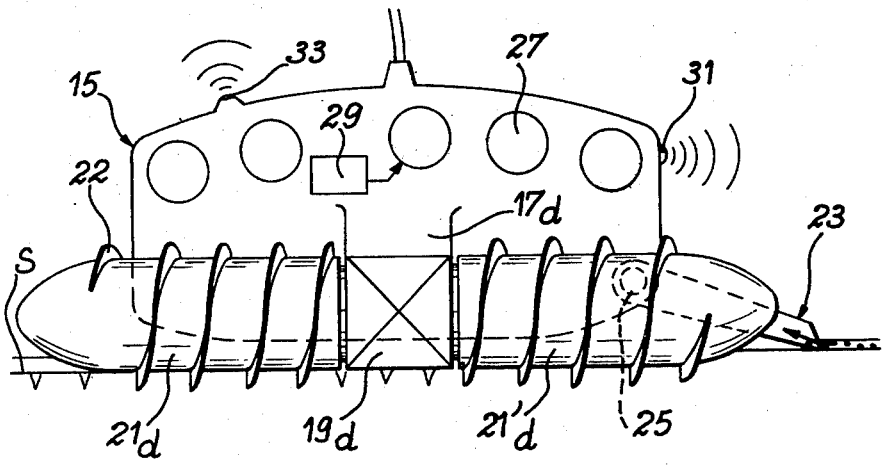
Figure 3B:
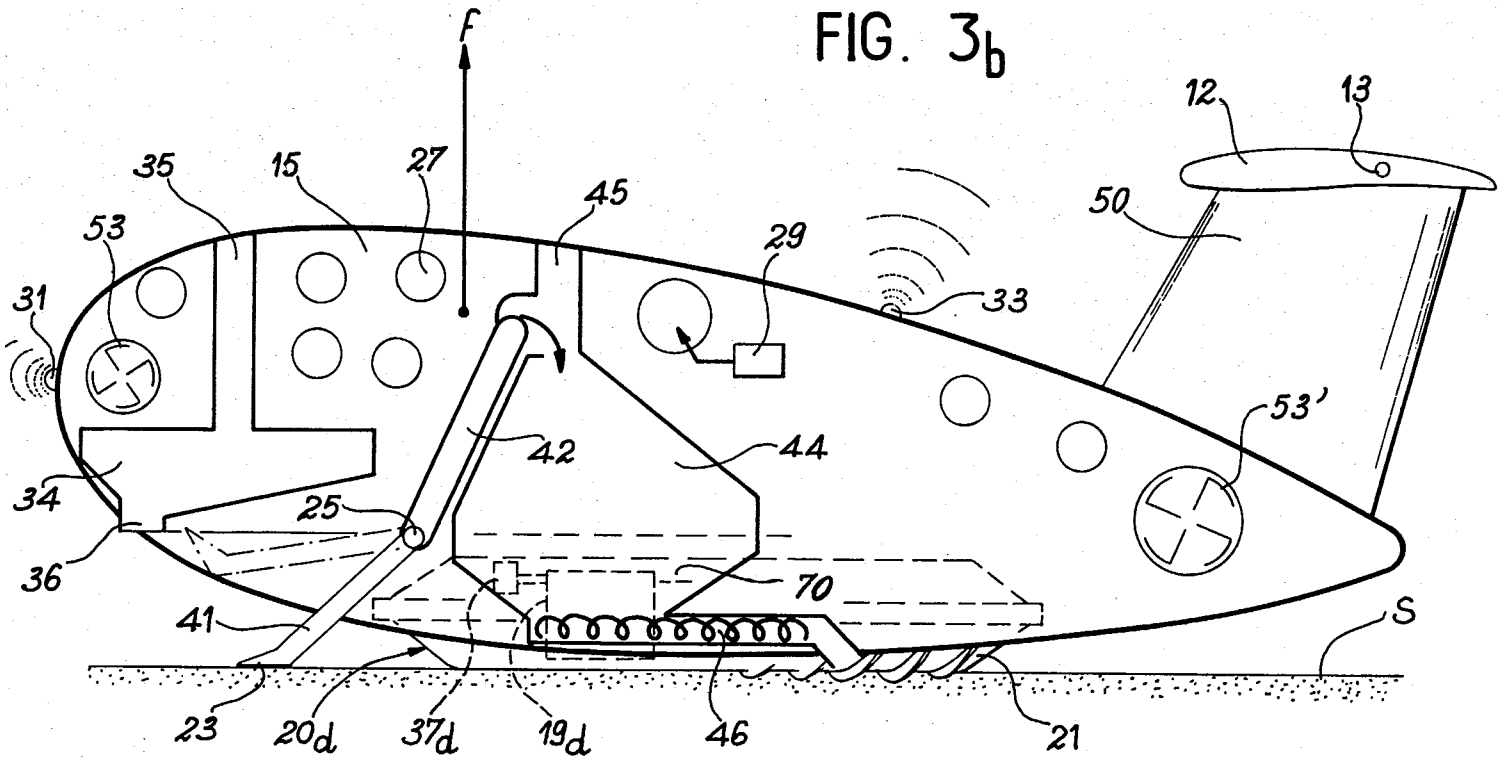
Figure 3C:
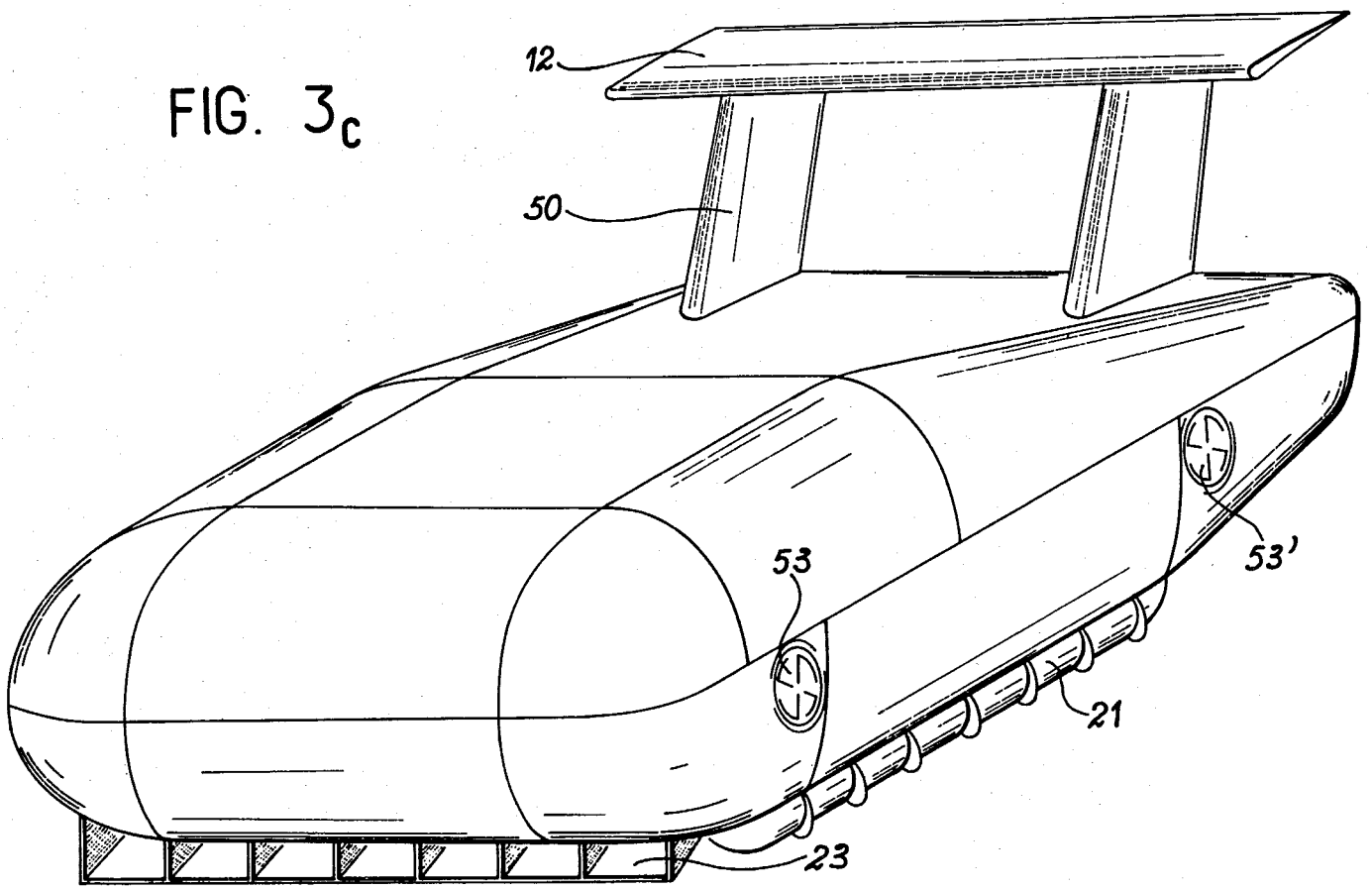

Further distinctive features and advantages of the present invention will become more clearly apparent from the following description which relates to examples of construction of the nodule-collecting vehicle in accordance with the invention and to a system for exploitation of a nodule deposit in which a number of vehicles in accordance with the invention are employed. In the description given hereinafter, reference will be made to the diagrammatic figures of the accompanying drawings, in which:

FIG. 1 illustrates the mode of exploitation of a deposit of polymetallic nodules by means of self-propelled vehicles in accordance with the invention as shown in FIGS. 3 and 4 and by means of a surface platform in accordance with any one of the alternative embodiments aforementioned;

FIG. 2*a* illustrates the process of downward travel, dredging and upward return of the self-propelled vehicle in which the positions of the vehicles, of the center of gravity and of the center of thrust are shown in the different stages;

FIG. 2*b* illustrates a safety device for producing action at the moment of initiation of the vehicle landing stage;

FIG. 3*a* is a side view showing a first alternative embodiment of the collecting vehicle in accordance with the invention;

FIG. 3*b* is a sectional view showing a second alternative embodiment of the vehicle in accordance with the invention;

FIG. 3*c* is a perspective view showing the vehicle in accordance with the same alternative embodiment as in FIG. 3*b;*

Figure 4A:
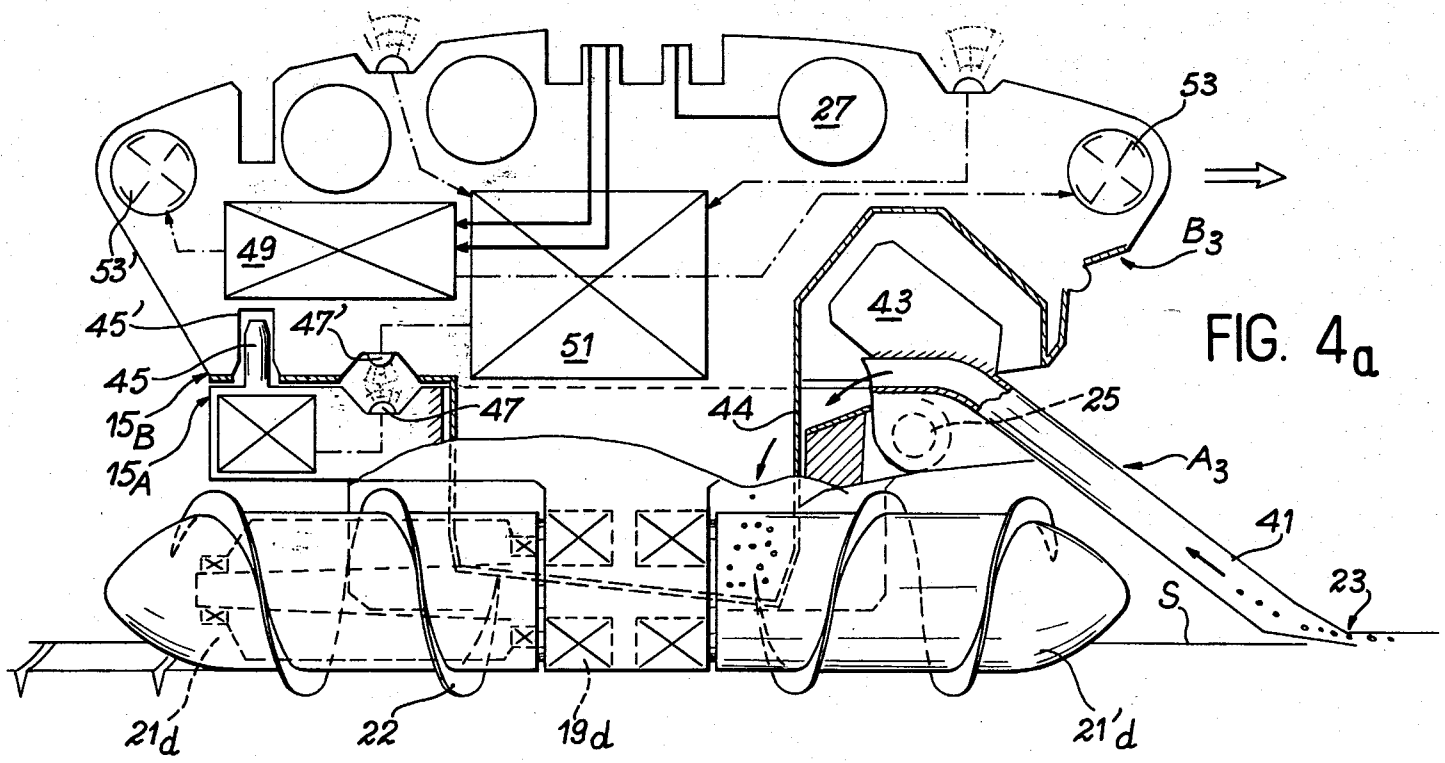
Figure 4B:
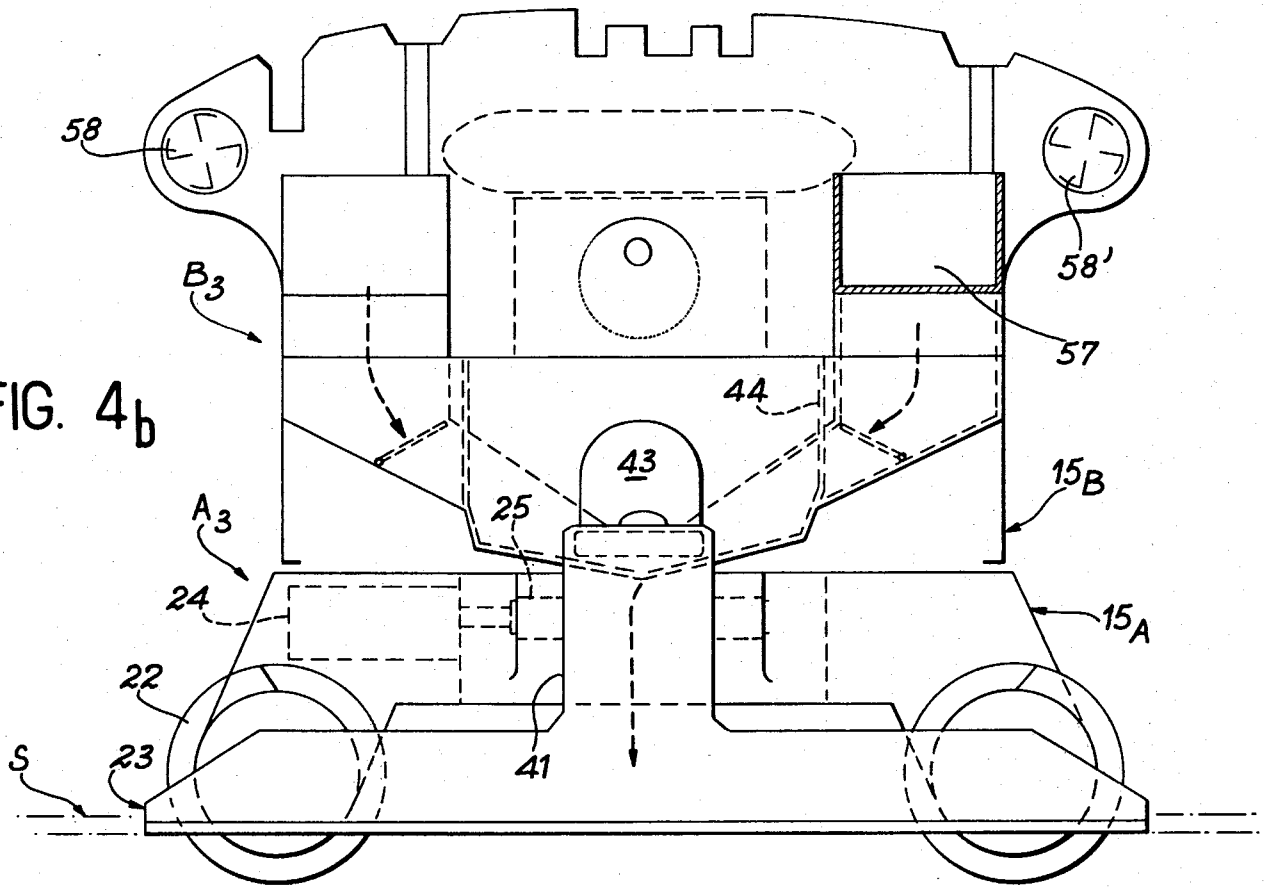

FIGS. 4*a* and 4*b* are respectively a side view and a front view of a third alternative embodiment of the vehicle in accordance with the invention in which said vehicle is constituted by two separable modules.

There is shown diagrammatically in FIG. 1 the mode of exploitation of a zone delimited by three marker buoys $b_1$, $b_2$, $b_3$ of a deposit G by means of vehicles $\mathbf{1}_a$, $\mathbf{1}_b$, $\mathbf{1}_c$, $\mathbf{1}_d$, $\mathbf{1}_e$, $\mathbf{1}_f$, $\mathbf{1}_g$ which carry their own sources of power or alternatively by means of a vehicle 2 which is advantageously composed of two disconnectable modules $A_3$ and $B_3$. A separate and distinct exploitation zone corresponds to each marker buoy, thus preventing any danger of collision. These marker buoys and zones are displaced as the exploitation proceeds.

It is apparent that the vehicles $\mathbf{1}_a$ to $\mathbf{1}_g$ and 2 which have their own power source are intended not only to collect nodules but also to carry out upward transfer of these latter to the vicinity of the surface and discharge into the station 3; this station 3 can be constituted by the nodule-processing plant.

The vehicles mentioned above have suitable ballasting capacities for downward travel as well as upward return and generally speaking for underwater operation in the direction of the station 3 or of the sea floor. Provision is also made for different approach elements which serve to carry out docking operations for coupling the vehicle with the station 3.

It is readily apparent that a suitable number of vehicles such as those designated by the references $1_a$ to $1_g$ or 2 make it possible to achieve rational and satisfactory exploitation of a deposit G, taking into account the different times of dredging, upward travel, discharge, reconditioning and downward return.

It is also apparent from FIG. 1 that the vehicle 2 which is intended to carry out upward transportation of nodules to the vicinity of the surface in the same manner as the vehicles $1_a$ to $1_g$ is advantageously constituted by two separable modules $A_3$ and $B_3$; this avoids the need to locate the dredging trace which has been abandoned by the vehicle 2 when this latter has completed its filling operation.

There is shown in FIG. 1 the upper module $B_3$ which is in course of raising the nodules to the station 3 whilst the base module $A_3$ is maintained stationary on the sea bottom until the return of a module similar to $B_3$.

It can readily be understood that a suitable number of upward-transfer modules $B_3$ makes it possible to match the nodule-collection capacities with the capacities of the platform and/or of the processing plant 3.

It can further be noted that the upward displacement of a vehicle for repair purposes can be carried out in accordance with the same principle by means of a module of the type designated by the reference $B_3$, said module being endowed with a suitable degree of buoyancy.

FIG. 1 further illustrates the surface platform 3 which, in the example chosen, corresponds to the preferential alternative embodiment in which said platform also carries the plant for chemical processing of nodules.

As shown in the figure, docking stations such as those designated by the references 4 and 4' are provided in the immersed portion of the platform for self-propelled vehicles which travel up and down between said platform and the sea floor. The means for unloading nodules and the means for loading the vehicles with ballast are connected to said docking stations. Energy-recharging is carried out by exchange of electric batteries which are carried on board the vehicle. For maintenance purposes, the vehicle is lifted by conventional means onto the top deck of the platform.

The platform is provided with immersed silos 5, the contents of which are at equal pressure with respect to the surrounding water, thus making it possible to reduce the thickness of the walls to a considerable extent. Taking into account the dimensions of the platform, said silos are located at depths of the order of 40 to 50 meters, the pressure being therefore between 4 and 5 bar. Said silos are designed for receiving discharged nodules and for storing sterile wastes resulting from the treatment prior to taking these latter on board the vehicle as releasable ballast.

It can be mentioned by way of example that the sterile wastes just mentioned represent approximately 98% of the weight of collected nodules. It is therefore necessary to store approximately 23% excess sterile ores or equivalent products in order to provide the excess ballast which is necessary for the vehicle; as will be explained hereinafter, this excess represents a proportion of 20%.

The following capacities can be contemplated:

In the case of each self-propelled vehicle:

400 (metric) tons on no load 100 tons of wet nodules or 120 tons of steriles.

In the case of the entire exploitation system:

12 shuttle vehicles, three of which are capable of dredging at the same time;

Production: 1.5 million tons per annum of dry nodules;

Tonnage of the platform: 150,000 tons.

One vehicle would perform an average four round trips per day, the mean duration of one cycle being approximately six hours. The number of dredging days per annum would be approximately 300.

Three additional shuttle vehicles would make it possible to ensure maintenance without stoppage of the dredging site. In the case of shuttle vehicles which are separable so as to form two modules, provision would be made for three dredging modules of type $A_3$ and for twelve silo modules of type $B_3$ for an equivalent capacity of the exploitation system.

For the purpose of ensuring maintenance without stoppage of the dredging site, it would be necessary to have two modules $A_3$ and three modules $B_3$.

FIG. 2*a* shows the process of downward travel, landing on the sea bottom, dredging, upward return and docking of a self-propelled vehicle.

A vehicle of type 1 is shown in the successive stages of downward travel (6), landing on the bottom (7), dredging (8), upward return (9) and docking (10). In stage 6, the vehicle follows a steeply inclined path (45° to 60°). To this end, the point of application of the total weight $P_6$ is located in front of and below the center of flotation at which the Archimedean thrust f is exerted on the vehicle. This effect ensures the angle of dive and the longitudinal component of excess weight ($P_6$-f) results in a speed $x_6$ of downward travel, the perpendicular component being cancelled by the hydrodynamic lift as in the case of a glider. A tail-plane serves to adjust the angle of inclination by means of the force $g_6$ which is represented in this case in the direction in which it assists the diving motion. A simple automatic system which calls for low power consumption serves to ensure programmed guiding along a downward path having a constant slope. The lateral steering means are not shown in the drawings since these latter are of a conventional type in submarine vehicles.

The bottom-landing stage 7 is triggered by a detector which determines the distance between the vehicle and the sea floor and controls the displacement of the point of application of the weight at $P_7$ beneath the center of flotation.

In the preferential alternative embodiment, part of the excess ballast which is located at the forward end is released, thereby reducing the speed and changing the trim of the vehicle at the same time. The weight $P_7$ then becomes lower than $P_6$ by approximately 5%. Under these conditions, early triggering of the ballast-release operation produces a substantial speed reduction (the speed of the vehicle decreases from 1 m/s to 0.25 m/s) and the vehicle comes to rest on the bottom in a flat position without being subjected to any dangerous impact since the vertical component of velocity is very small. Correct triggering results in soft landing at 0.5 m/s (dredging speed), the flattening action produced by a change in weight being assisted by elevation of the tail-plane 12 and by start-up of the propulsion cylinders.

There is shown in FIG. 2*b* a safety device comprising a balance-weight 11 which is suspended from the tail-plane by a cable and maintains said plane in the diving position until it comes into contact with the sea floor. At this moment, the cable relieves the tension, the plane pivots about its axis 13 and produces a movement of elevation. In one advantageous embodiment, the cable which passes over pulleys serve to transfer the balance-weight to the forward end. At the same time, a second balance-weight 14 which is suspended from a cable at the forward end of the vehicle maintains control of the opening of the ballast silo. In the same manner, the movement of approach at a predetermined distance from the sea floor has the effect of triggering the release of that portion of the ballast which is necessarily intended to perform the landing operation.

The dredging stage 8 calls for a weight $P_8$ which differs only very slightly from the weight $P_7$ and is higher than the Archimedean thrust f, thus ensuring engagement of the helical propulsion units in the sea bed. As will be explained below, release of the ballast serve to compensate for the increasing excess weight resulting from the dredging operation.

The point of application of the weight $P_8$ is below the center of thrust and can be located slightly to the rear.

On completion of the dredging operation, a final ballast release at the forward end of the vehicle has the effect at the same time of reducing the weight $P_9$ to a value below $P_8$ and of displacing its point of application to the rear of the center of thrust. This initiates the stage of upward return at an angle of trim which is reverse to that of downward motion, this stage being assisted by the elevation tail-plane (force $g_9$).

The stage of docking beneath the platform 3 at the predetermined station 4 entails the use of the tail-plane and of auxiliary propulsion units for resumption of a horizontal path. Should there be any difficulty involved in return of the vehicle to the horizontal, the excess buoyancy which served to produce upward motion would bring the vehicle to the surface. In order to prevent this emergence which could result in damage to the vehicle in the event of bad weather, a portion of the buoyancy body 14 can in such a case be released at the forward end, thus restoring normal trim and zero buoyancy to the vehicle.

The operation just mentioned can also be replaced or facilitated by flooding a ballast located at the forward end. The operations are readily controlled by reason of the low depth of the vehicle during this docking stage.

FIG. 3*a* is a profile view of the vehicle in accordance with the invention which will be employed for the exploitation of a nodule deposit in accordance with a first alternative embodiment in the same manner as the vehicles $\mathbf{1}_a$, $\mathbf{1}_b$, $\mathbf{1}_c$, $\mathbf{1}_d$, $\mathbf{1}_e$, $\mathbf{1}_f$ of FIG. 1.

The vehicle body 15 is constituted by an open structure filled with lightweight material constituted by an assembly of microspheres embedded in a resin. If necessary, said lightweight material can be combined with spheres which afford resistance to the hydrostatic pressure at this depth.

In another known manner, the specific weight of the vehicle can be nullified by having recourse to a light liquid.

It is apparent from the above-mentioned FIG. 3*a* in which the right-hand side of the vehicle is shown by way of example that the vehicle body 15 aforesaid is provided with lateral extensions such as the extension $\mathbf{17}_d$ in the case of the right-hand side. Each extension is rigidly fixed to a reduction-gear motor $\mathbf{19}_d$ for driving in rotation two units $\mathbf{21}_d$ and $\mathbf{21}_d'$ which are of revolution with respect to a common axis and applied against the surface S of a sea bed.

The aforementioned units $\mathbf{21}_d$ and $\mathbf{21}_d'$ as well as the similar units on the left side of the vehicle which are intended to support said vehicle body 15 and to ensure the propulsion of this latter are adapted to carry on the external face thereof at least one propulsion fin 22 which is wound on said units in a helix with a constant pitch, the pitch of the fins 22 of the units $\mathbf{21}_d$ and $\mathbf{21}_d'$ being opposite to the pitch of the fins of the units on the left side of the vehicle.

Thus at the time of rotational motion of the units $\mathbf{21}_d$, $\mathbf{21}_d'$, $\mathbf{21}_g$ and $\mathbf{21}_g'$ the external faces of said unit serve to support the vehicle on the sea-bed surface S and the lateral faces of the fin 22 which is engaged in the sea-bed surface S carry out the propulsion of the vehicle, the operation of said vehicle being performed as a result of relative variation of the speeds of the motors $\mathbf{19}_d$ and its counterpart motor on the left side of the vehicle.

It is worthy of note that the movement of rotation above a low minimum speed of said units $\mathbf{21}_{d,g}$ and $\mathbf{21}_{d,g}'$ and of their propulsion fins 22 causes displacement of the water between the sea bed S and said units. This has the effect of producing a continuous dynamic application of the vehicle against the bed S and eliminating any adherence of the sediments to the units while these latter are in motion. It can be noted that the movement of rotation of the units $\mathbf{21}_d$, $\mathbf{21}_d'$ and $\mathbf{21}_g$, $\mathbf{21}_g'$ in the opposite direction cancels any transverse reaction.

Moreover, it is apparent that the vehicle body 15 is adapted to carry at the forward end a dredge 23 having a width either greater than or equal to the overall width of the vehicle, said dredge 23 being mounted on a pivot-pin 25 associated with means (not shown in this figure) for adjusting the inclination of said dredge 23 with respect to the body 15 when the units $\mathbf{21}_{d,g}$ and $\mathbf{21}_{d,g}'$ penetrate into the sea bed S to a greater or lesser extent and thus to adjust the penetration of the dredge in the sediment.

It is possible to encounter a certain increase in the degree of penetration of the units into the sea bed S by reason of the fact that, when the units $\mathbf{21}_{d,g}$ and $\mathbf{21}_{d,g}'$ penetrate to a greater depth within the sea bed S, the bearing surface of the units increases and the very soft bed which has a higher specific volume than that of the water produces an increasing effect of hydrostatic lift and a supporting capacity which is related to its cohesion.

For the recovery of nodules collected by said dredge 23, the vehicle is clearly equipped with means for raising the nodules (not shown in this figure). These hydraulic or mechanical means are preferably associated with the dredge 23 and with a storage silo arranged within said vehicle body 15 and provided with means for emptying said silo.

For the purpose of steering while dredging is in progress, the vehicle body 15 aforesaid is further equipped with various detecting devices such as an obstacle detector 31 and a responder 33. Said body is also provided with a control system (not shown in this figure) for controlling the reduction-gear motors in dependence on the detectors afore-said in order to drive the units in rotation as well as the means for adjusting the inclination of the dredge with respect to the vehicle body.

In accordance with the invention, the self-propelled vehicle is further equipped with a system for adjusting its specific weight, especially in order to permit downward motion of the vehicle from the surface platform followed by landing on the sea floor, to compensate for the increase in specific weight of the vehicle at the time of storage of the nodules in the silo, to reduce the weight of the vehicle with a view to adapting this latter to appreciable variations in level of the sea floor and to permit upward return of said vehicle at the end of the dredging period.

In a second alternative embodiment of the vehicle contemplated by the invention, FIG. 3*b* shows in greater detail the means employed for modifying the specific weight and displacing the point of application of the resultant force as well as the means for adjusting and regulating the paths followed by the vehicle. The components shown in this figure are designated by the same references as in FIG. 3*a*.

As indicated earlier, the use of the hydropneumatic ballast has been reduced to a small portion of the specific weight adjustment. The element for controlling this portion of adjustment is represented diagrammatically by the device 29 for emptying or flooding a pressure-resistant chamber. The essential feature of the preferred embodiment of the invention lies in the fact that the buoyancy unit balances the vehicle in the completely filled condition.

FIG. 3*b* shows the arrangement of storages of ballast and of nodules for carrying out the stages described in FIG. 2*a*. At the forward end and in the lower portion of the buoyancy unit for the flotation of agglomerate consisting of microspheres and of large spheres such as those designated by the reference 27, a silo 34 is provided for the ballast with a filling orifice 35 and an emptying orifice 36. The silo is reserved for excess ballast and, when half full, makes it possible to establish an equilibrium between the vehicle and the nodule silo 44 when this latter is completely full. The silo 44 which is located beneath the center of thrust f receives the nodules collected by the dredge 23 which are passed upwards by the conveyor 41 and the elevator 42.

There has been shown beneath the dashed line at 57 the lower portion of the main ballast silo which coincides with the nodule silo 44 in this figure.

It will in fact be noted that the sterile waste derived from the treatment of the nodules themselves in the preferred embodiment of the invention is a product which has a smaller particle size than that of the nodules, which has the same apparent density in water and which may even exhibit a lower increase in volume than that of the nodules.

There is also illustrated a form of vehicle in accordance with the invention in which the silos 44 and 57 are constituted by the same enclosure. In this case, the emptying element 46 serve to evacuate the sterile material to the bottom of the silo as the nodules of equivalent or smaller volume are supplied at the top. This sterile material is discharged to the rear over the surface which has already been dredged.

In another alternative embodiment, the silos 57 for sterile material are shown by way of example on each side of a silo 44 which serves to receive nodules. It is easier in this case to provide separate devices which are suited to the transfer of sterile material in the form of a thick slurry, these devices being necessarily different from the nodule units.

The orifice 45 serves to fill the ballast silo with sterile material. It will further be noted from this figure 3*b* that the vehicle has a streamlined or faired shape which is suited to the operations of downward and upward transfer described in FIG. 2*a*.

In an advantageous embodiment shown in FIG. 3*c*, the vehicle is flat and of substantial width. The width is in any case imposed by the size of the dredge 23. For a production of 100 (metric) tons per hour at a dredging rate of 0.5 $ms^{-1}$, this dredge has a width of approximately 12 m. The shape mentioned above has the effect of offering low resistance to lateral currents on the sea floor and contributes in particular to buoyancy for downward travel, landing and docking.

The center of gravity of the secondary silo 34 for sterile material is the point of application of the excess weight of the vehicle and located near the forward end for downward travel. When the silo 34 is empty, the vehicle is on the contrary of light weight at the forward end for upward travel. The tail-plane 12 constitutes a stabilizing plane so as to permit underwater operations and guiding along the downward path.

FIGS. 3*b* and 3*c* also show the vertical planes such as those which are designated by the reference 50 and carry the steering tail-planes (not shown).

For operation at low speed, tunnel propulsion units 53, 53' permit directional control operations and lateral displacement for the purpose of docking.

The sea-floor propulsion units 21 (FIGS. 3*b* and 3*c*) shown in dashed lines are preferably flush-mounted in the fairing in this embodiment. This has a further advantage in that the belly of the vehicle is in contact with the surface of the sea bed in the event of excessive penetration of the bodies 21 of revolution and that these latter are in a half-tunnel at the time of utilization for underwater propulsion, thus improving their efficiency.

In accordance with this alternative embodiment, the reduction-gear motor $19_d$ is housed within a unit $20_d$ which corresponds to the two units $21_d$ and $21_d'$ of FIG. 3*a*. The unit 20*d* is shown in FIG. 3*b*, this unit connected with reduction gear motor 19*d* through the device 37*d*.

In consequence, the reduction-gear motor $19_d$ carried by a stationary shaft 70 which is rigidly fixed to the vehicle body 15 drives said unit $20_d$ in rotation by means of a hydraulic coupler or by means of a gear and pinion system $37_d$.

The alternative embodiment described in the foregoing has the advantage of eliminating the gap created for the propulsion of the vehicle by separating a supporting and/or propulsion unit into two parts by means of a reduction-gear motor 19.

The storage batteries for the operation of the different motors are not shown in FIGS. 3*b* and 3*c*.

The vehicle in accordance with the invention as shown in the embodiment of FIGS. 2 and 3 can also comprise complementary propulsion units consisting of at least one vertical unit and if necessary of a longitudinal propulsion unit which can be assisted or replaced by the movement of rotation of the units 21*d* or 21*d'* at a sufficient speed.

The profile view of FIG. 4*a* and the front view of FIG. 4*b* show another alternative embodiment of the vehicle in accordance with the invention. In this embodiment, the vehicle is made up of two separable modules, the two modules being respectively designated as a base module $A_3$ and as an upward-transfer module $B_3$.

It is pointed out that the vehicle of FIGS. 4*a* and 4*b* will be employed for the exploitation of a nodule deposit as in the case of the vehicle 2 shown in FIG. 1.

As can readily be understood, the vehicle components which have already been illustrated in the previous figures will be designated by the same reference numerals.

From these figures it can thus be seen that the base module $A_3$ comprises the reduction-gear motors $19_d$ and its left counterpart which are rigidly fixed to the vehicle body $15_A$ and intended to drive the units $21_d$, $21_d'$, and their left counterparts in rotation. Said motors carry the dredge 23 which is mounted on said vehicle body 15A on the pivot 25, said pivot being connected to the motor 24 (shown in FIG. 4*b*) for adjusting the angle of inclination of the dredge 23 with respect to the body 15A.

FIG. 4*a* shows the device for mechanical lifting of nodules as constituted by an Archimedean screw 41 driven by the motor 43, said screw being housed within the upper portion of the dredge 23.

It is observed that the aforementioned vehicle body 15A is provided in the upper central portion thereof with a cavity for receiving the lower central portion of the upward-transfer module $B_3$ in which are arranged the silo 57 for releasable ballast and the storage silo 44, with coupling means 45 which are intended to cooperate with complementary means 45' formed in the lower portion of the upward-transfer module $B_3$ and with an approach device 47 in cooperating relation with the approach device 47' of the upward-transfer module $B_3$ for a docking operation between a module $B_3$ and a module $A_3$.

It can be noted that the two bodies 15A and 15B of the two modules $A_3$ and $B_3$ have complementary shapes for ensuring that the nodules can readily be transferred into the storage silo 44.

It can further be noted that, in accordance with one of the distinctive features of the alternative embodiment of the vehicle shown in FIGS. 4*a* and 4*b*, the upward-transfer module $B_3$ comprises at least one propulsion unit for generating a longitudinal thrust with respect to the body 15B such as the propulsion units 58, 58' (shown in FIG. 4*b*), at least one propulsion unit for generating a vertical thrust (not shown) and at least one propulsion unit for generating a transverse thrust with respect to the body 15B such as the propulsion units 53 and 53'.

There can also be seen within the upward-transfer module $B_3$ the spheres 27 of the fixed buoyancy unit. There have also been shown diagrammatically within the module B the power-supply storage batteries 49 and a unit 51 which serves to control the means for operating the ballasting system, the propulsion units 53 and 58, the reduction-gear motors $19_d$ and $19_g$ and the motors 24, 43 in dependence on the different detectors and devices in accordance with the invention.

Thus the module $B_3$ of a vehicle in accordance with the invention as shown in the embodiment of FIGS. 4*a* and 4*b* is capable of moving upwards especially for emptying the silo 44 and charging the batteries 49, to a surface platform such as the processing plant 5 of FIG. 1, in which case the module $A_3$ is maintained stationary on the sea floor S. It is noted that the plant 5 is provided with means for underwater docking of vehicles and with silos for the storage of nodules and of releasable ballast employed by the vehicles.

Another noteworthy point is that the cavity 57 for containing the releasable ballast can be filled with sterile ores which are preferably constituted by residues from the processing of nodules which is carried out in the surface plant.

What we claim is:

1. A method of exploitation of a deposit of polymetallic nodules on a sea floor from a platform located at the surface of the sea, said polymetallic nodules comprising metallic material and sterile material, said nodules being adapted to be treated for separating the sterile material from the metallic material, said method including the steps of, (a) charging with energy a plurality of self-propelled vehicles, said vehicles being provided with means for dredging and stocking said nodules, and loading said vehicles with releasable ballast, (b) downwardly displacing said vehicles into the sea from the platform under the action of excess ballast, (c) releasing a portion of said excess ballast at the vehicles' approach to the sea floor to make softer the landing of the vehicle on the sea floor, (d) propelling said vehicles on the sea floor by self-propelling means carried by the vehicles, the self-propelling means consisting of at least two supporting units of revolutions, each said unit being provided with at least one helical propulsion fin, in order to dredge and stock said nodules, and simultaneously and progressively releasing said ballast so that said released ballast permanently compensates for the added weight of the stocked nodules, (e) upwardly displacing said vehicles back to the platform by releasing the remaining portion of ballast, (f) discharging the stocked nodules on said platform.

2. A method according to claim 1 wherein the treatment of nodules is carried out by a plant located on the surface platform.

3. A method according to claim 1 wherein the paths of upward motion and downward motion of the vehicles are adjusted by means of tail-planes.

4. A method according to claim 1, wherein during operations involving landing on the sea floor or docking to the platform, the apparent weight of the vehicles is adjusted by acting on hydropneumatic ballasting system associated with the ballast releasing means.

5. A method according to claim 4, wherein at least one said vehicle is equipped with a buoyancy unit, the normal trim and zero buoyancy being restored to said vehicle during docking operations by releasing a part of the buoyancy unit.

6. A method according to claim 5 wherein the step of loading with ballast said vehicles consists in stocking the releasable ballast in two silos provided within each of said vehicles one silo being placed at the forward end of a vehicle the other being placed beneath the center of flotation of said vehicles.

7. A method according to claim 6 wherein the step of stocking said nodules within each of said vehicles consists of stocking said nodules within a further silo placed beneath the center of flotation and having an apparent weight capacity which is smaller than the sum of the capacity of the two silos aforesaid.

8. A method according to claim 6 wherein the step of releasing a portion of said excess ballast consists of opening the silo placed at the forward end of the vehicle when said vehicle approaches a predetermined distance from the sea floor.

9. A method according to claim 1 wherein the step of releasing a portion of said excess of ballast at the approach of said sea floor consists in suspending a weight to the vehicle by means of a cable, and providing said cable with such a length that, when said weight touches the sea floor, the force due to the weight is no longer applied to the vehicle, the weight is disconnected from the vehicle.

10. A method according to claim 1, wherein the releasable ballast loaded within said self-propelled vehicles is mostly constituted by the sterile material derived from the treatment of the nodules themselves.

* * * * *